US007040107B2

(12) United States Patent
Lee et al.

(10) Patent No.: US 7,040,107 B2
(45) Date of Patent: May 9, 2006

(54) AIR CONDITIONER AND METHOD OF CONTROLLING THE SAME

(75) Inventors: In Ju Lee, Yongin (KR); Cheol Woo Kim, Seongnam (KR); Sung Hea Cho, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 132 days.

(21) Appl. No.: 10/819,173

(22) Filed: Apr. 7, 2004

(65) Prior Publication Data

US 2005/0050908 A1 Mar. 10, 2005

(30) Foreign Application Priority Data

Sep. 4, 2003 (KR) ..... 10-2003-0061765

(51) Int. Cl.
*F25B 1/00* (2006.01)
*F25B 49/00* (2006.01)
*F04B 17/00* (2006.01)

(52) U.S. Cl. ..... 62/228.5; 62/230; 62/510; 417/325

(58) Field of Classification Search ..... 62/228.1, 62/228.3, 228.5, 230, 510, 199, 200; 417/325
See application file for complete search history.

(56) References Cited

U.S. PATENT DOCUMENTS

| | | | | |
|---|---|---|---|---|
| 2,976,807 | A * | 3/1961 | Hill | 417/325 |
| 4,248,053 | A | 2/1981 | Sisk | |
| 4,912,936 | A * | 4/1990 | Denpou | 62/158 |
| 5,142,877 | A * | 9/1992 | Shimizu | 62/129 |
| 6,648,604 | B1 * | 11/2003 | Lifson | 417/53 |

FOREIGN PATENT DOCUMENTS

JP 08210277 A * 8/1996

* cited by examiner

*Primary Examiner*—Marc Norman
(74) *Attorney, Agent, or Firm*—Staas & Halsey LLP

(57) ABSTRACT

An air conditioner has a variable capacity rotary compressor, which allows the compressor to be smoothly re-started, thus increasing start reliability of the compressor. The air conditioner includes a compressor rotated in opposite directions. A drive unit rotates the compressor in a forward or reverse direction. A start determining unit determines whether the compressor has started to rotate in a forward direction or not. A control unit operates the drive unit so as to rotate the compressor in a direction opposite to the forward direction, and then re-start the compressor in the forward direction, when the compressor has failed to start. The air conditioner and a method of controlling the air conditioner allow the compressor to be smoothly and rapidly re-started even when the compressor has failed to re-start, thus increasing start reliability, and shortening a time required to re-start the compressor.

27 Claims, 8 Drawing Sheets

AIR CONDITIONER AND METHOD OF CONTROLLING THE SAME

CROSS-REFERENCE TO RELATED APPLICATION

This application claims the benefit of Korean Patent Application No. 2003-61765, filed Sep. 4, 2003 in the Korean Intellectual Property Office, the disclosure of which is incorporated herein by reference.

BACKGROUND OF THE INVENTION

1. Field of the Invention

The present invention relates, in general, to air conditioners and, more particularly, to an air conditioner and a method of controlling the air conditioner, which allow a compressor to be smoothly started.

2. Description of the Related Art

Generally, a compressor functions to compress a low-pressure refrigerant which flows into an inlet side of the compressor using an eccentric unit mounted to a rotating shaft. A high-pressure refrigerant which is compressed by the eccentric unit is discharged to an outlet side of the compressor.

When it is required to temporarily stop and then re-start the compressor-due to various factors, the compressor is not smoothly re-started due to a difference in pressure between the inlet side and the outlet side of the compressor.

To smoothly re-start the compressor, according to related art, an electric expansion valve between an outdoor unit and an indoor unit is opened for a period of time to equalize a pressure of the inlet side with a pressure of the outlet side prior to re-starting the compressor.

However, when there is a small pressure difference between the inlet side and the outlet side of the compressor despite opening the electric expansion valve for the period of time, the compressor fails to re-start.

Further, when the compressor is not re-started for lengthy periods, a motor of the compressor is overloaded, thus resulting in damage to the compressor.

The above-mentioned problem is more frequently found in a variable capacity rotary compressor which is frequently stopped to vary compression capacity.

In Korean Patent Application No. 2002-61462 there is disclosed a variable capacity rotary compressor. In that application, the compressor was designed to execute a compression operation in either of two compression chambers having different interior capacities.

The variable capacity rotary compressor is designed to execute the compression operation in either of the two compression chambers while executing an idle operation in a remaining one of the two compression chambers by an eccentric unit, thus easily varying the compression capacity as desired by changing a rotating direction of a rotating shaft.

In an air conditioner having the variable capacity rotary compressor, when a required capacity of an indoor unit is changed, the motor of the compressor is temporarily stopped to vary a discharging amount of the refrigerant according to the required capacity of the indoor unit. Subsequently, after an elapse of a pressure equalizing period, the motor of the compressor is rotated in a direction opposite to an original rotating direction to execute a compression operation in a compression chamber where an idle rotation of the eccentric unit has been executed, thus re-starting the variable capacity rotary compressor.

However, in the conventional air conditioner, a refrigerant is slightly compressed by the rotation of the motor of the compressor even in the compression chamber where the idle rotation of the eccentric unit is executed. Thus, when the motor of the compressor is rotated to execute the compression operation in the compression chamber where the idle rotation of the eccentric unit has been executed, the rotation of the motor of the compressor may be restrained due to imbalance of pressure in the compression chamber. Thereby, the compressor may fail to re-start, thus lowering the probability of a successful re-starting. Further, in the conventional air conditioner, when the compression operation is executed in a compression chamber having a large capacity, the motor of the compressor is driven using a main winding of the motor, which has a relatively large mobile power. On the other hand, when the compression operation is executed in a compression chamber having a small capacity, the motor of the compressor is driven using a subsidiary winding of the motor, which has a relatively small mobile power. Thus, in the case of starting the compressor to execute the compression operation in the compression chamber having the small capacity, the mobile power is relatively low. Thereby, there is a higher probability that the compressor will fail to start.

Further, when a frictional resistance between an inner surface of a compression chamber and a roller which is in contact with the inner surface of the compression chamber is temporarily increased due to a mechanical allowance, the compressor may fail to start, resulting in a reduction of start reliability.

SUMMARY OF THE INVENTION

Accordingly, it is an aspect of the present invention to provide an air conditioner and a method of controlling the air conditioner, which allow a compressor to be smoothly started, thus increasing start reliability of the compressor.

The above and/or other aspects are achieved by providing an air conditioner, including a compressor which is rotated in opposing directions, a drive unit which rotates the compressor in a forward or reverse direction, a start determining unit which determines whether the compressor has been started to rotate in a particular direction or not, and a control unit which operates the drive unit so as to rotate the compressor in a direction opposite to the particular direction, and then re-start the compressor in the particular direction, when the compressor has failed to start.

The above and/or other aspects are further achieved by providing a method of controlling an air conditioner which has a compressor which is rotated in opposing directions, the method including starting the compressor to rotate the compressor in a forward direction, determining whether the compressor has started to rotate in the forward direction or not, and re-starting the compressor in the forward direction after rotating the compressor in a reverse direction, when the compressor has failed to start.

Further, the above and/or other aspects are achieved by providing a compressor control device, including a compressor which is rotated in opposing directions, a drive unit which rotates the compressor in a forward or reverse direction, a start determining unit which determines whether the compressor has started to rotate in a particular direction or not, and a control unit which operates the drive unit so as to rotate the compressor in a direction opposite to the particular direction, and then re-start the compressor in the particular direction, when the compressor has failed to start.

Additional aspects and/or other advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of embodiments, taken in conjunction with the accompanying drawings of which.

DETAILED DESCRIPTION OF THE EMBODIMENTS

Figure 1:
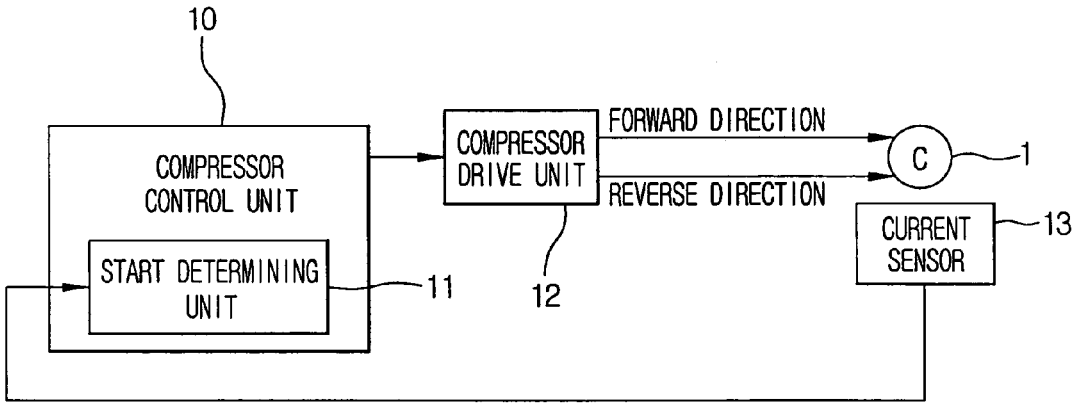
FIG. 1 is a control block diagram showing an operation of a variable capacity rotary compressor included in an air conditioner, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a control block diagram showing an operation of a variable capacity rotary compressor 1 included in an air conditioner, according to an embodiment of the present invention. As shown in FIG. 1, the air conditioner includes a compressor control unit 10, a start determining unit 11, a compressor drive unit 12, and a current sensor 13.

The current sensor 13 detects a current induced in a motor winding of the compressor 1.

The start determining unit 11 determines whether the compressor 1 has been started or not, according to a current value output from the current sensor 13. When the output current value is higher than a preset current value, the start determining unit 11 determines that the compressor 1 has failed to start. Meanwhile, when the output current value is lower than the preset current value, the start determining unit 11 determines that the compressor 1 has started.

The compressor drive unit 12 functions to rotate the compressor 1 in a forward or reverse direction.

When the compressor 1 has failed to start, the compressor control unit 10 operates the compressor drive unit 12 so that the compressor 1 is re-started in a forward direction after being rotated in a reverse direction, so as to smoothly start the compressor 1. Such an operation prevents a difference of pressure from building between an inlet side and an outlet side of the compressor 1, and prevents occurrence of a frictional resistance between a first or second eccentric unit 40, 50 and an inner surface of a first or second compression chamber 31, 32 which is in contact with the eccentric unit 40, 50, respectively, thus resulting in a smooth start of the compressor 1 and shortening a time required to re-start the compressor 1.

The air conditioner and the method of controlling the air conditioner according to the present invention will be described in the following.

Figure 2:
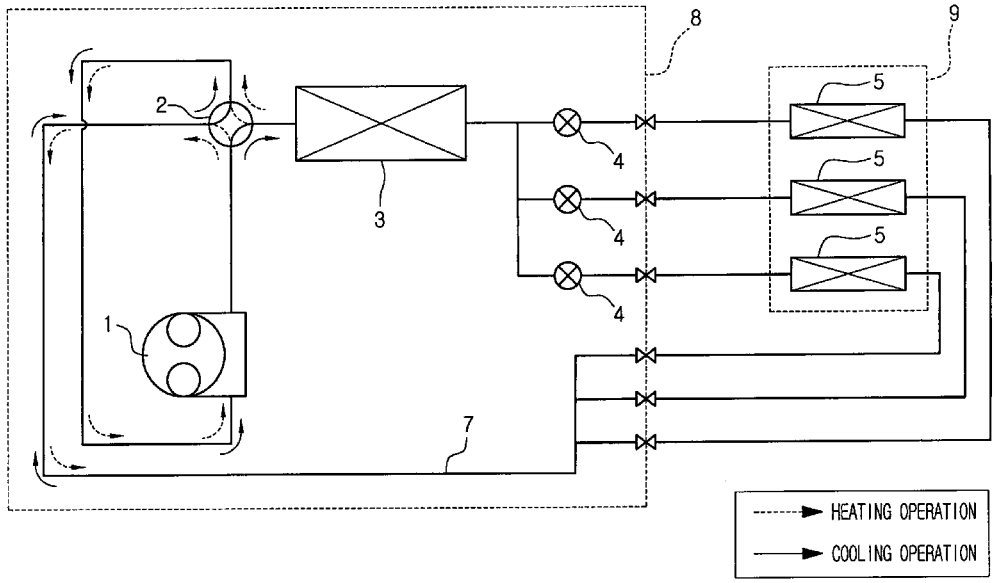
FIG. 2 is a circuit diagram of the air conditioner having the variable capacity rotary compressor of FIG. 1.

FIG. 2 is a circuit diagram of the air conditioner, according to an embodiment of the present invention. Referring to FIG. 2, the air conditioner includes the variable capacity rotary compressor 1, a mode-switching four-way valve 2, a condenser 3, electric expansion valves 4, and evaporators 5, which are sequentially connected to each other by refrigerant pipes to form a closed circuit. Of the refrigerant pipes, a high-pressure pipe 6 connects the outlet side of the variable capacity rotary compressor 1 to inlet sides of the electric expansion valves 4, and guides a refrigerant under high pressure which is discharged from the variable capacity rotary compressor 1. A low-pressure pipe 7 connects outlet sides of the electric expansion valves 4 to the inlet side of the compressor 1, and guides a refrigerant under low pressure which is expanded in the electric expansion valves 4. The condenser 3 is installed at a position of the high-pressure pipe 6, while the evaporators 5 are installed at various positions of the low-pressure pipe 7. When the variable capacity rotary compressor 1 is operated in a cooling mode, the refrigerant flows along a direction shown by solid arrows in FIG. 2. On the other hand, when the variable capacity rotary compressor 1 is operated in a heating mode, the refrigerant flows along a direction shown by dotted arrows in FIG. 2.

The air conditioner also includes an outdoor unit 8 and several indoor units 9. The outdoor unit 8 includes the variable capacity rotary compressor 1, the condenser 3, and the electric expansion valves 4. The indoor units 9 are arranged in parallel with each other. In this case, each of the indoor units 9 has one evaporator 5. Thus, the air conditioner is designed such that several indoor units 9 are connected to one outdoor unit 8. The indoor units 9 may have the same capacity and construction, or may have different capacities and constructions.

The variable capacity rotary compressor 1 and the electric expansion valve 4 are electrically connected to a control unit so as to be driven in response to a control signal of the control unit.

Figure 3:
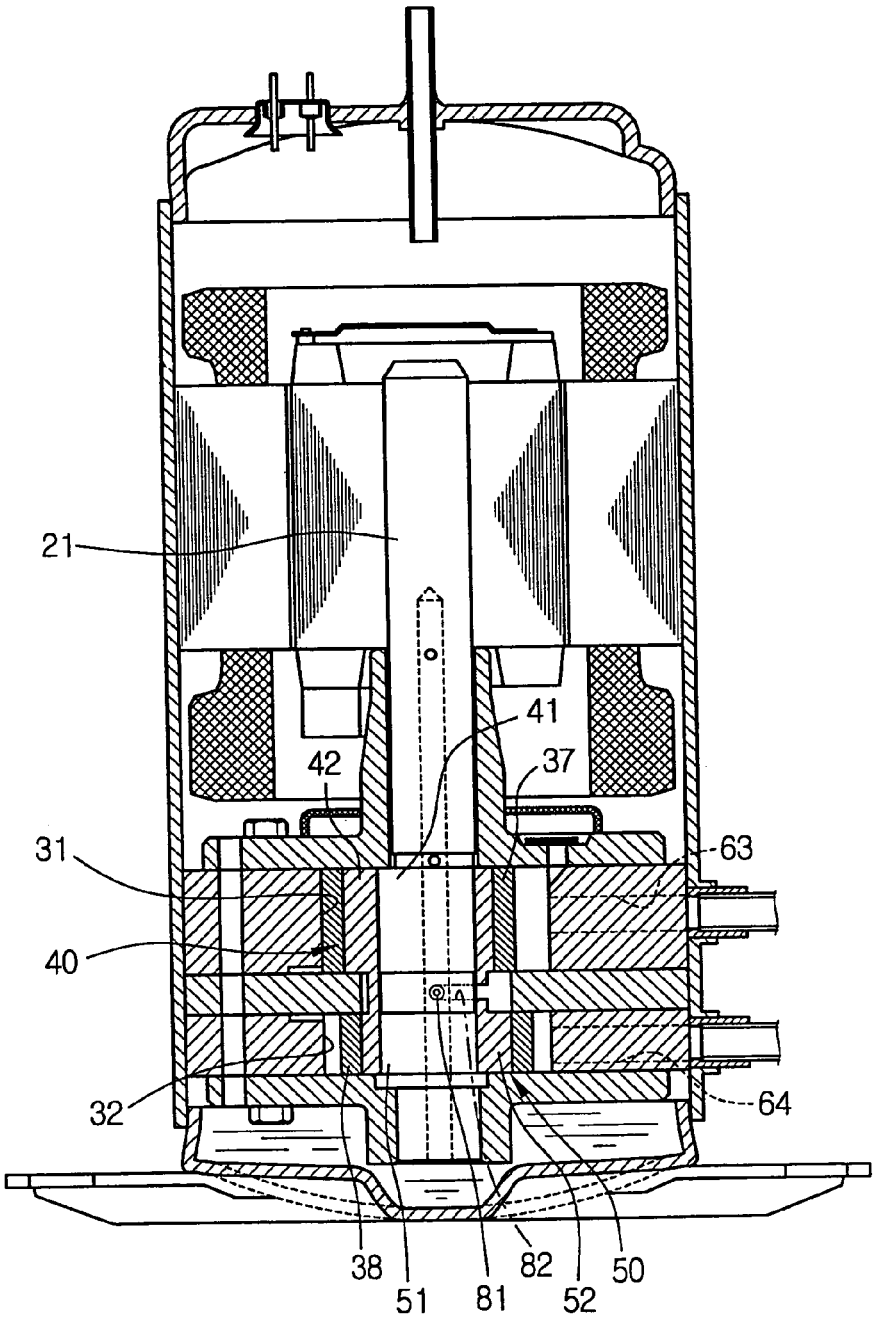
FIG. 3 is a sectional view of the variable capacity rotary compressor of FIG. 2.

As shown in FIG. 3, the variable capacity rotary compressor 1 of the outdoor unit 8 includes the first and second compression chambers 31 and 32. The first and second eccentric units 40 and 50 are respectively provided in the first and second compression chambers 31 and 32. The first eccentric unit 40 is operated to execute a compression operation or an idle operation in the first compression chamber 31 by a first roller 37 which is eccentric from or released from eccentricity from a rotating shaft 21, according to a rotating direction of the rotating shaft 21 which is rotated by a motor of the compressor 1. In this case, the first roller 37 is provided in the first compression chamber 31. Similarly, the second eccentric unit 50 is operated to execute the compression operation or the idle operation in the second compression chamber 32 by a second roller 38 which is eccentric from or released from eccentricity from the rotating shaft 21, according to a rotating direction of the rotating shaft 21 which is rotated by the motor of the compressor 1. In this case, the second roller 38 is provided in the second compression chamber 32.

As shown in FIG. 4, the first eccentric unit 40 includes a first eccentric cam 41, a first eccentric bush 42, and the first roller 37, while the second eccentric unit 50 includes a second eccentric cam 51, a second eccentric bush 52, and the second roller 38. The first and second eccentric cams 41 and 51 are provided on an outer surface of the rotating shaft 21. The first and second eccentric bushes 42 and 52 are rotatably fitted over the first and second eccentric cams 41 and 51, respectively, and are eccentric from the rotating shaft 21 in opposite directions. The first and second rollers 37 and 38 are rotatably fitted over the first and second eccentric bushes 42 and 52, respectively. A locking pin 81 is provided on the rotating shaft 21 to make one of the first and second eccentric bushes 42 and 52 eccentric from the rotating shaft 21 while releasing a remaining one of the first and second eccentric bushes 42 and 52 from eccentricity from the rotating shaft 21, according to the rotating direction of the rotating shaft 21. Further, first and second vanes 61 and 62 (see FIGS. 3 and 4) are respectively provided in the first and second compression chambers 31 and 32 to be reciprocated in a radial direction of the rotating shaft 21. The first vane 61 partitions the first compression chamber 31 into an intake space and a discharging space, while the second vane 62 partitions the second compression chamber 32 into an intake space and a discharging space. The reference numeral 63 denotes a first inlet port, and the reference numeral 64 denotes a second inlet port.

Figure 4A:
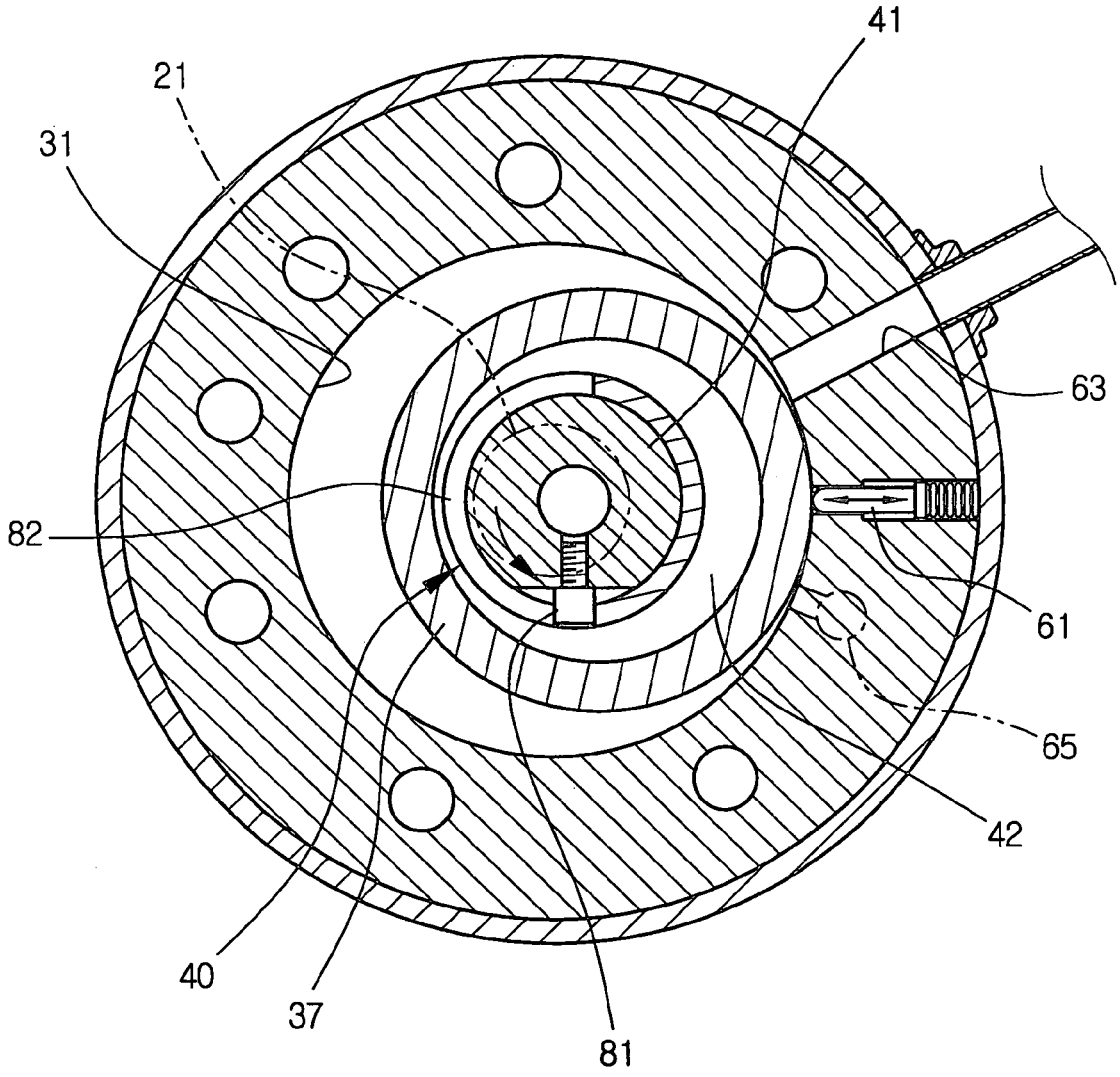
FIGS. 4A and 4B are sectional views of first and second compression chambers, respectively, when a rotating shaft included in the variable capacity rotary compressor of FIG. 3 is rotated in a forward direction.
Figure 4B:
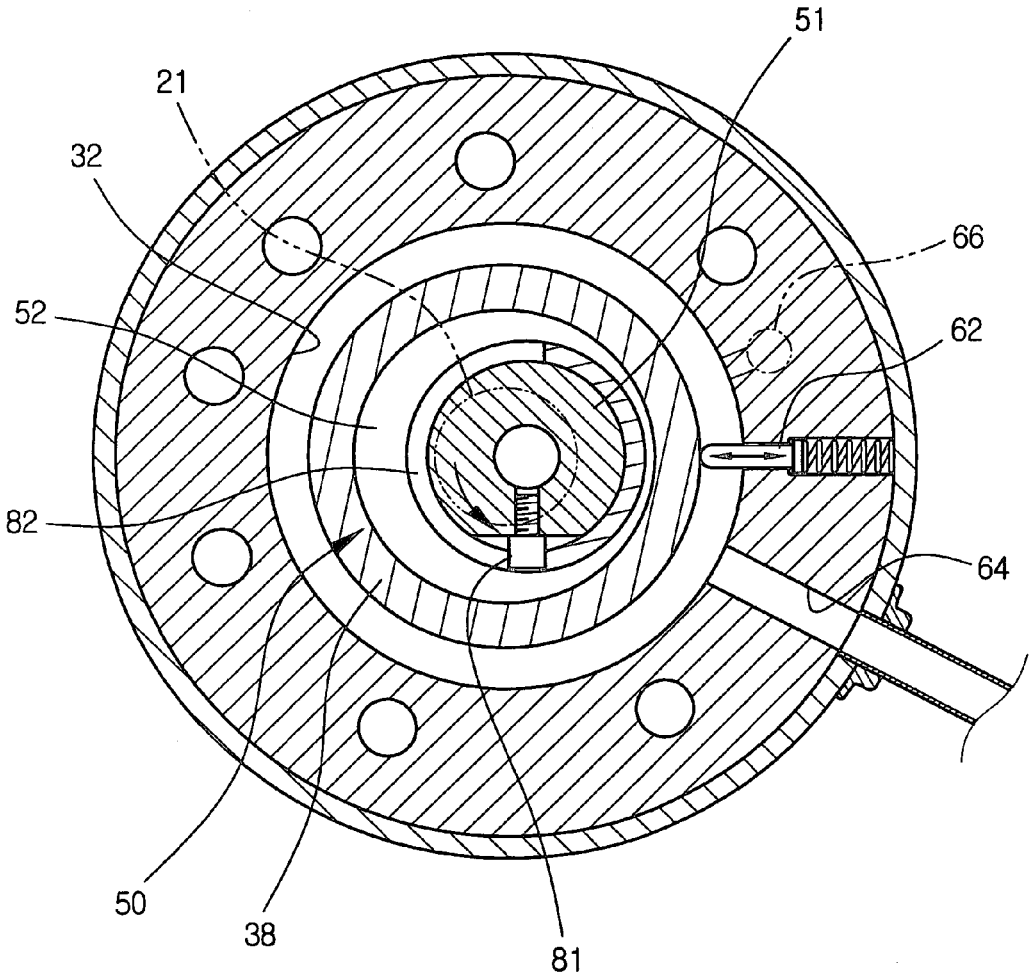

In the variable capacity rotary compressor 1, when the rotating shaft 21 is rotated in the forward direction as shown in FIG. 4A, an outer surface of the first eccentric bush 42 of the first compression chamber 31 is eccentric from the rotating shaft 21, and the locking pin 81 contacts a first end of a locking slot 82. At this time, the first roller 37 is rotated while in contact with the inner surface of the first compression chamber 31, thus executing the compression operation in the first compression chamber 31. On the other hand, in the case of the second compression chamber 32, as shown in FIG. 4B, an outer surface of the second eccentric bush 52 and the second roller 38 are spaced apart from the inner surface of the second compression chamber 32. Further, the outer surface of the second eccentric bush 52 is concentric with the rotating shaft 21. Thus, the idle operation is executed in the second compression chamber 32. The reference numeral 65 denotes a first outlet port, and the reference numeral 66 denotes a second outlet port.

Figure 5A:
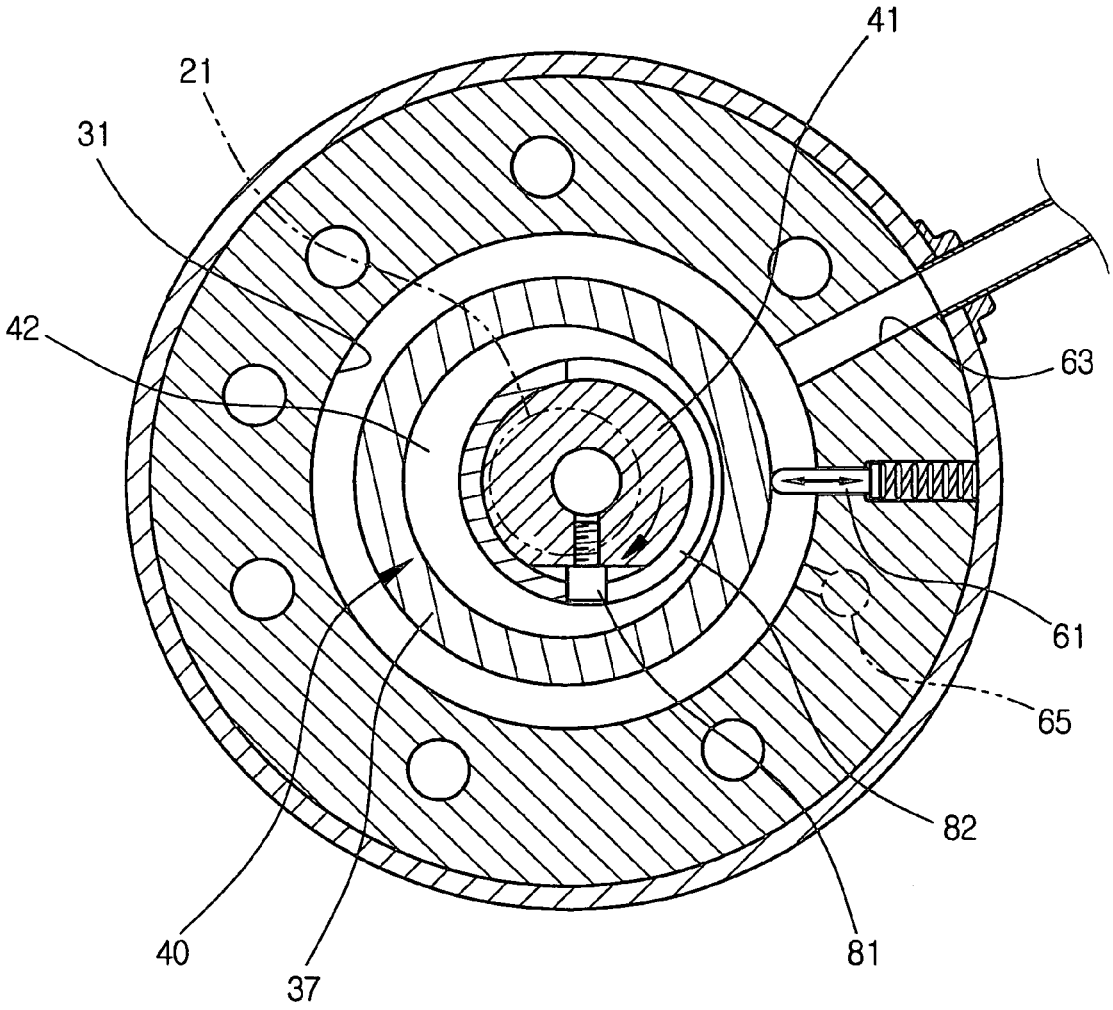
FIGS. 5A and 5B are sectional views of the first and second compression chambers, respectively, when the rotating shaft included in the variable capacity rotary compressor of FIG. 3 is rotated in a reverse direction.
Figure 5B:
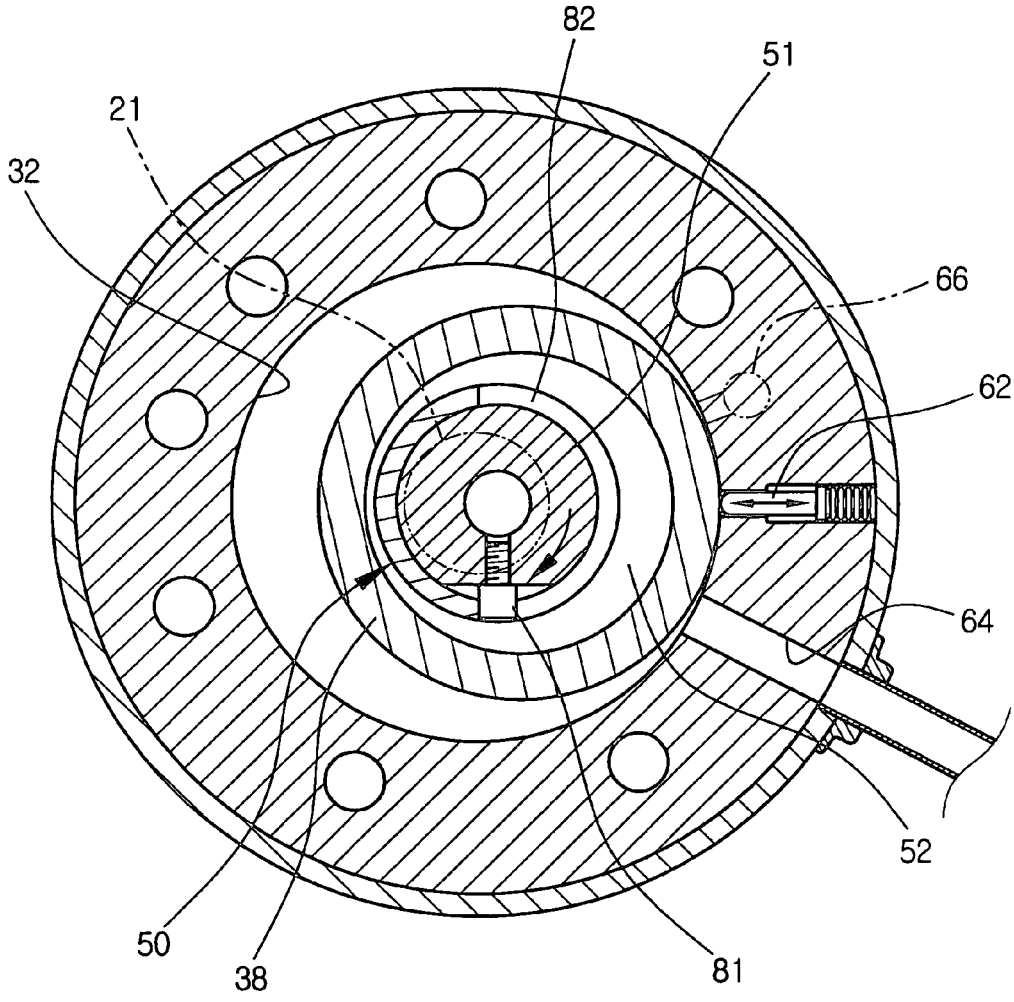

When the rotating shaft 21 is rotated in the reverse direction, as shown in FIG. 5A, the outer surface of the first eccentric bush 42 provided in the first compression chamber 31 is released from eccentricity from the rotating shaft 21, and the locking pin 81 contacts a second end of the locking slot 82. At this time, the first roller 37 is rotated while spaced apart from the inner surface of the first compression chamber 31. Thus, the idle operation is executed in the first compression chamber 31. On the other hand, in the case of the second compression chamber 32, as shown in FIG. 5B, the outer surface of the second eccentric bush 52 is eccentric from the rotating shaft 21, and the second roller 38 is rotated while in contact with the inner surface of the second compression chamber 32. Thus, the compression operation is executed in the second compression chamber 32.

Figure 6:
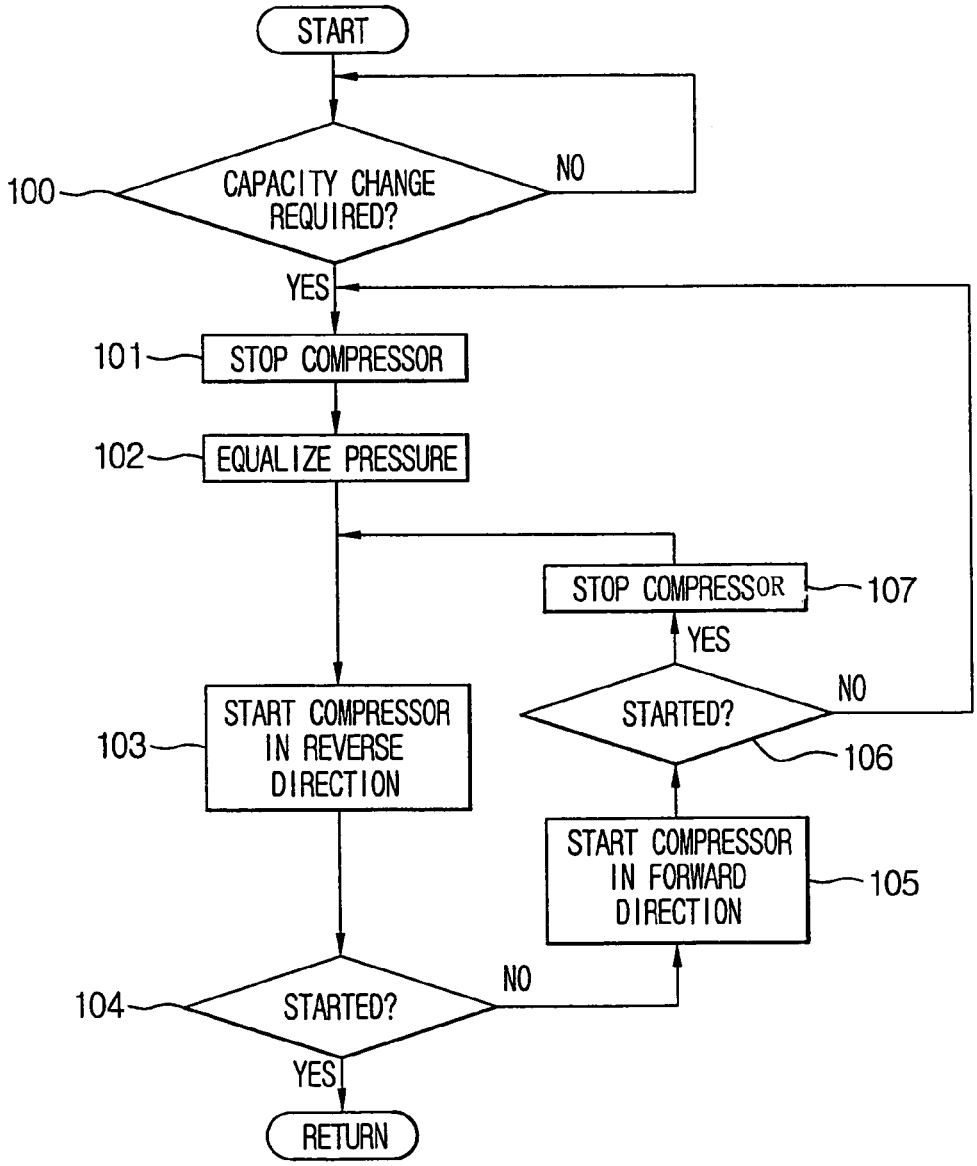
FIG. 6 is a flowchart showing a method of controlling the air conditioner of FIG. 2.

FIG. 6 is a flowchart showing a method of controlling the air conditioner of FIG. 2. Referring to FIGS. 1, 2, 3, and 6, it is determined whether a required capacity of an indoor unit 9 is changed or not in operation 100. When it is determined that the required capacity of the indoor unit 9 has been changed in operation 100, the compressor control unit 10 stops the compressor 1 in operation 101 prior to rotating the compressor 1 in a reverse direction. For a simple description, it is assumed that the compressor 1 has been rotated in a forward direction, before the required capacity of the indoor unit 9 is changed.

Thereafter, the electric expansion valve 4 provided on a refrigerant cycle is opened for a period of time to equalize a pressure between a low-pressure side and a high-pressure side of the refrigerant cycle, in operation 102. The pressure equalizing operation may be continued for two minutes, for example.

After the pressure equalizing operation has been carried out for the period of time in operation 102, the compressor control unit 10 starts the compressor 1 in the reverse direction.

After the compressor 1 was started in the reverse direction in operation 103, the compressor control unit 10 determines whether the start of the compressor 1 has successfully executed or not, on the basis of a current value detected by the current sensor 13 which detects a current induced in the motor winding of the compressor 1, in operation 104. When the compressor 1 has successfully started, the current value is temporarily increased, and subsequently reduced to a normal level. However, when the compressor 1 has failed to start, the motor of the compressor 1 is overloaded, resulting in a rapid increase in the current value. Thus, when the value of the current flowing through the motor winding is higher than a preset current value, it is determined that the compressor 1 has failed to start. Conversely, when the current value is lower than the preset current value, it is determined that the compressor 1 has started.

When it is determined that the compressor 1 has failed to start in operation 104, the compressor 1 is stopped. In this case, it is considered that the failure of the start of the compressor 1 is caused by an imbalance of pressure between the inlet and outlet sides of the first, second compression chamber 31, 32 and a temporary increase in a frictional resistance between the first or second roller 37, 38 and the inner surface of the first or second compression chamber 31, 32, due to a mechanical allowance.

To address the cause of the failure to start the compressor 1, the compressor 1 is started in the forward direction, in operation 105. Next, the compressor control unit 10 determines that the compressor 1 has started in the forward direction in operation 106, in a same manner as operation 104. When the compressor 1 has failed to start, it is determined that the start failure of the compressor 1 is caused by reasons other than the above-mentioned reasons. In this case, the operation of controlling the air conditioner is returned to operation 101.

Meanwhile, when it is determined that the compressor 1 has successfully started in operation 106, the eccentric unit 40, 50 is rotated in the forward direction to address the cause of the failure to start the compressor, that is, the imbalance of pressure in the first or second compression chamber 31, 32, and the frictional resistance between the first or second roller 37, 38 and the inner surface of the first or second compression chamber 31, 32.

When it is determined that the compressor 1 has successfully started in operation 106, the compressor 1 which is rotated in the forward direction is stopped in operation 107, to be re-started in the reverse direction. Thereafter the compressor 1 is re-started in the reverse direction in operation 103. Since the compressor 1 is re-started after addressing the cause of the failure to start the compressor 1 in operation 106, the compressor 1 is smoothly re-started, in operation 103. Further, when the compressor 1 is temporarily operated in a direction opposite to a re-starting direction of the compressor 1, the cause of the start failure is rapidly overcome, thus shortening a time required to re-start the compressor 1.

As is apparent from the above description, the present invention provides an air conditioner and a method of controlling the air conditioner, which allow a compressor to be smoothly started, thus increasing start reliability of the compressor.

Further, the present invention provides an air conditioner and a method of controlling the air conditioner, which allow the compressor to be rapidly re-started even when the compressor has failed to be started, thus shortening a time required to re-start the compressor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air conditioner, comprising:

a compressor which rotates in opposing directions;

a drive unit which rotates the compressor in a first or second direction depending upon a required capacity of the air conditioner;

a start determining unit which determines whether the compressor has started to rotate in the first direction; and a control unit which operates the drive unit so as to rotate the compressor in the second direction opposite to the first direction when the required capacity of the air conditioner changes, and then re-start the compressor in the first direction, when the compressor has failed to start in the second direction.

2. The air conditioner according to claim 1, further comprising:

a current sensor which detects a current induced in a motor winding of the compressor and which outputs a current value, wherein the start determining unit determines whether the compressor has started according to the current value output from the current sensor.

3. The air conditioner according to claim 1, wherein a difference in pressure is prevented between an inlet side and an outlet side of the compressor.

4. The air conditioner according to claim 1, further comprising:

a plurality of indoor units each having an evaporator and arranged in parallel; and an outdoor unit including the compressor, a condenser and a plurality of electric expansion valves, wherein the plurality of indoor units are connected to the outdoor unit.

5. The air conditioner according to claim 4, wherein the plurality of indoor units have identical capacities and construction.

6. An air conditioner comprising:

a compressor which rotates in opposing directions;

a drive unit which rotates the compressor in a first or second direction;

a start determining unit which determines whether the compressor has started to rotate in the first direction; and a control unit which operates the drive unit so as to rotate the compressor in the second direction opposite to the first direction, and then re-start the compressor in the first direction, when the compressor has failed to start, wherein the compressor includes a variable capacity rotary compressor, the variable capacity rotary compressor including:

first and second compression chambers having different interior capacities;

a motor which rotates a rotating shaft; and a first eccentric unit which is eccentric from the rotating shaft or released from eccentricity from the rotating shaft, according to a rotating direction of the rotating shaft, executing a compression operation in either of the first and second compression chambers while executing an idle operation in a remaining one of the first and second compression chambers.

7. The air conditioner according to claim 6, wherein a frictional resistance is prevented between the first eccentric unit and an inner surface of at least one of the first and second compression chambers in contact with the first eccentric unit.

8. The air conditioner according to claim 6, further comprising:

a mode-switching four-way valve;

a condenser;

a plurality of electric expansion valves;

a plurality of evaporators; and refrigerant piping, wherein the compressor, the mode-switching four-way valve, the condenser, the electric expansion valves and the evaporators are sequentially connected by the refrigerant piping to form a closed circuit.

9. The air conditioner according to claim 8, wherein the refrigerant piping includes a high-pressure pipe which connects an outlet side of the compressor to inlet sides of the electric expansion valves, the high-pressure pipe guiding a refrigerant under high pressure discharged from the compressor.

10. The air conditioner according to claim 9, wherein the refrigerant piping includes a low-pressure pipe which connects outlet sides of the electric expansion valves to an inlet side of the compressor, the low-pressure pipe guiding a refrigerant under low pressure expanded in the electric expansion valves.

11. The air conditioner according to claim 10, wherein the condenser is disposed on the high-pressure pipe and the evaporators are disposed on the low-pressure pipe.

12. The air conditioner according to claim 8, further comprising:

a second eccentric unit, wherein the first and second eccentric units are disposed in the first and second compression chambers, respectively.

13. The air conditioner according to claim 12, wherein the first and eccentric units include first and second eccentric cams, first and second eccentric bushes, first and second locking slots and first and second rollers, respectively.

14. The air conditioner according to claim 13, further comprising:

a locking pin on the rotating shaft, the locking pin making at least one of the first and second eccentric bushes eccentric from the rotating shaft and releasing a remaining one of the first and second eccentric bushes from eccentricity from the rotating shaft, wherein the first and second eccentric cams are disposed on an outer surface of the rotating shaft in opposite directions, and wherein the first and second rollers are rotatably fitted over the first and second eccentric bushes, respectively.

15. The air conditioner according to claim 14, wherein an outer surface of the first eccentric bush in the first compression chamber is eccentric from the rotating shaft and the locking pin contacts a first end of the first locking slot when the rotating shaft is rotated in a first direction, and wherein the first roller is rotated while in contact with an inner surface of the first compression chamber to execute a compression operation.

16. The air conditioner according to claim 12, further comprising:

first and second vanes disposed in the first and second compression chambers, respectively, wherein the first and second vanes partition the first and second compression chambers into a first and second intake space and a first and second discharging space, respectively.

17. The air conditioner according to claim 16, wherein the outer surface of the first eccentric bush in the first compression chamber is released from eccentricity from the rotating shaft and the locking pin contacts a second end of the first locking slot when the rotating shaft is rotated in a second direction opposite the first direction, and wherein the first roller is rotated while spaced apart from the inner surface of the first compression chamber to execute an idle operation.

18. A method of controlling an air conditioner, the air conditioner having a compressor which is rotatable in opposing directions, the method comprising:

starting the compressor to rotate the compressor in a first direction;

determining whether the compressor has started to rotate in the first direction; and starting the compressor to rotate in a second direction when a required capacity of the air conditioner has changed;

re-starting the compressor in the first direction when the compressor has failed to start in the second direction.

19. The method according to claim 18, wherein the determining whether the compressor has started comprises:

detecting a current induced in a motor winding of the compressor;

determining that the compressor has failed to start, when a value of the detected current is higher than a threshold current value; and determining that the compressor has started when the value of the detected current is lower than the threshold current value.

20. The method according to claim 18, wherein the re-starting prevents a difference of pressure from building up between an inlet side and an outlet side of the compressor.

21. A method of controlling an air conditioner, the air conditioner having a compressor which is rotatable in opposing directions, the method comprising:

starting the compressor to rotate the compressor in a first direction;

determining whether the compressor has started to rotate in the first direction; and re-starting the compressor in the first direction after rotating the compressor in a second direction, when the compressor has failed to start, wherein the compressor includes a variable capacity rotary compressor, the variable capacity rotary compressor including:

first and second compression chambers having different interior capacities, a compression operation being executed in either of the first and second compression chambers while an idle operation is executed in a remaining one of the first and second compression chambers, according to a rotating direction of a rotating shaft.

22. A compressor control device, comprising:

a compressor which rotates in opposing directions;

a drive unit which rotates the compressor in a first or second direction depending upon a required capacity of the air conditioner;

a start determining unit which determines whether the compressor has started to rotate in the first direction; and a control unit which operates the drive unit so as to rotate the compressor in the second direction opposite to the first direction when the required capacity of the air conditioner changes, and then re-start the compressor in the first direction, when the compressor has failed to start in the second direction.

23. The compressor control device according to claim 22, wherein the start determining unit determines whether the compressor has started or not according to a current value output from a current sensor which detects a current induced in a motor winding of the compressor.

24. A compressor control device comprising:

a compressor which rotates in opposing directions;

a drive unit which rotates the compressor in a first or second direction;

a start determining unit which determines whether the compressor has started to rotate in the first direction; and a control unit which operates the drive unit so as to rotate the compressor in the second direction opposite to the first direction, and then re-start the compressor in the first direction, when the compressor has failed to start, wherein the compressor includes a variable capacity rotary compressor, the variable capacity rotary compressor including:

first and second compression chambers having different interior capacities;

a motor which rotates a rotating shaft; and an eccentric unit which is eccentric from the rotating shaft or released from eccentricity from the rotating shaft, according to a rotating direction of the rotating shaft, executing a compression operation in either of the first and second compression chambers while executing an idle operation in a remaining one of the first and second compression chambers.

25. A method of controlling an air conditioner having a compressor, an eccentric unit, a drive unit, a start determining unit, and a control unit, the method comprising:

starting the compressor in a first direction by the control unit;

determining, by the start determining unit, whether the compressor has started in the first direction; and starting the compressor in a second direction by the control unit when a required capacity of the air conditioner changes;

stopping the compressor from rotating in the second direction and restarting the compressor in the first direction, when the compressor has failed to start in the second direction.

26. The method of controlling an air conditioner according to claim 25, further comprising:

rotating the eccentric unit in the first direction when the compressor has failed to successfully start to address a cause of the failure, wherein the cause of the failure includes at least one of the group consisting of a temporary increase in a frictional resistance and an imbalance of pressure.

27. The method of controlling an air conditioner according to claim 26, further comprising:

stopping the compressor which is rotated in the first direction; and re-starting the compressor in a second direction opposite the first direction after addressing the cause of the failure.

* * * * *

UNITED STATES PATENT AND TRADEMARK OFFICE

CERTIFICATE OF CORRECTION

PATENT NO. : 7,040,107 B2
APPLICATION NO. : 10/819173
DATED : May 9, 2006
INVENTOR(S) : In Ju Lee et al.

It is certified that error appears in the above-identified patent and that said Letters Patent is hereby corrected as shown below:

Column 8, line 52, before “eccentric units”, insert --second--

Column 10, line 58, change “restarting” to --re-starting--

Signed and Sealed this

Twenty-fourth Day of October, 2006

JON W. DUDAS
*Director of the United States Patent and Trademark Office*